United States Patent [19]

Miyazaki et al.

[11] 4,199,911

[45] Apr. 29, 1980

[54] COIN PACKAGING MACHINE

[75] Inventors: Yorizo Miyazaki; Katusuke Furuya, both of Tokyo, Japan

[73] Assignee: Laurel Bank Machine Co., Ltd., Tokyo, Japan

[21] Appl. No.: 963,679

[22] Filed: Nov. 27, 1978

[30] Foreign Application Priority Data

Nov. 28, 1977 [JP] Japan ..... 52-142428

[51] Int. Cl.[2] ..... B65B 57/06; B65B 57/08; B65B 11/04

[52] U.S. Cl. ..... 53/64; 53/505; 53/212

[58] Field of Search ..... 53/64, 505, 506, 212, 53/77

[56] References Cited

U.S. PATENT DOCUMENTS 3,531,913 10/1970 Uchida et al. ..... 53/212

3,906,964 9/1975 Ushio et al. ..... 53/77 X

*Primary Examiner*—Travis S. McGehee

*Attorney, Agent, or Firm*—Fleit & Jacobson

[57] ABSTRACT

Accumulated coins are introduced among packaging rollers by a supporting rod and gripped by the packaging rollers together with a packaging paper supplied from a source thereof. A paper detecting means is provided for detecting the presence of the paper. A circuit means is provided for reversely rotating a packaging motor to cause the packaging rollers to move back up to the position wherein the accumulated coins are not gripped.

3 Claims, 3 Drawing Figures

COIN PACKAGING MACHINE

BACKGROUND OF THE INVENTION

The present invention relates to a coin packaging machine in which, when a packaging paper is not fed at a predetermined timing to accumulated coins gripped and rotated by packaging rollers, the packaging mechanism is reversely operated so that the accumulated coins are fed back to the state at the point where they were introduced into the packaging rollers and the accumulated coins are stopped in this state, whereby scattering of coins in the packaging machine is prevented.

As known means for attaining the above object, there can be mentioned a system in which, even when a packaging paper is not fed to accumulated coins, packaging rollers continue rotation while gripping and supporting the accumulated coins therebetween until a packaging paper is supplied, the operation being interrupted when a packaging paper is manually fed, and after this manual feeding of the packaging paper the operation is started again to complete packaging of coins (see, for example, Japanese Utility Model Publication No. 27166/77).

This known structure necessitates a motor for rotation of packaging rollers and a cam line shaft driving motor for operating clamp jaws. This is a disadvantage since the packaging machine becomes expensive. Further, when a packaging paper is caught by some member or other during the feeding operation and is not fed to accumulated coins, the packaging rollers continue rotation while in direct contact with the periphery of the accumulated coins. The packaging rollers are therefore readily worn or damaged.

SUMMARY OF THE INVENTION

The present invention has been perfected as a result of research conducted with a view to eliminating the above-mentioned defects involved in the conventional coin packaging machines. More specifically, in accordance with the present invention, there is provided a coin packaging machine characterized in that if a packaging paper is not fed to a predetermined position for accumulated coins which have been gripped and rotated by packaging rollers, the coin-gripping action is released in the packaging rollers. In other words, the packaging rollers are operated in the reverse direction until the accumulated coins restored to the non-gripped state at the point of delivery of the accumulated coins from an accumulating cylinder to the packaging rollers in the packaging mechanism, and i in this state, the operation of the machine is stopped.

Therefore, there is no mechanical abrasion or generation of heat and the packaging rollers can be effectively prevented from being damaged, and further, wasteful use of operation time can be remarkably decreased.

BRIEF DESCRIPTION OF THE DRAWINGS

The present invention will now be described in detail by reference to an embodiment illustrated in the accompanying drawing in which.

DETAILED DESCRIPTION OF THE PREFERRED EMBODIMENTS OF THE INVENTION

Figure 1:
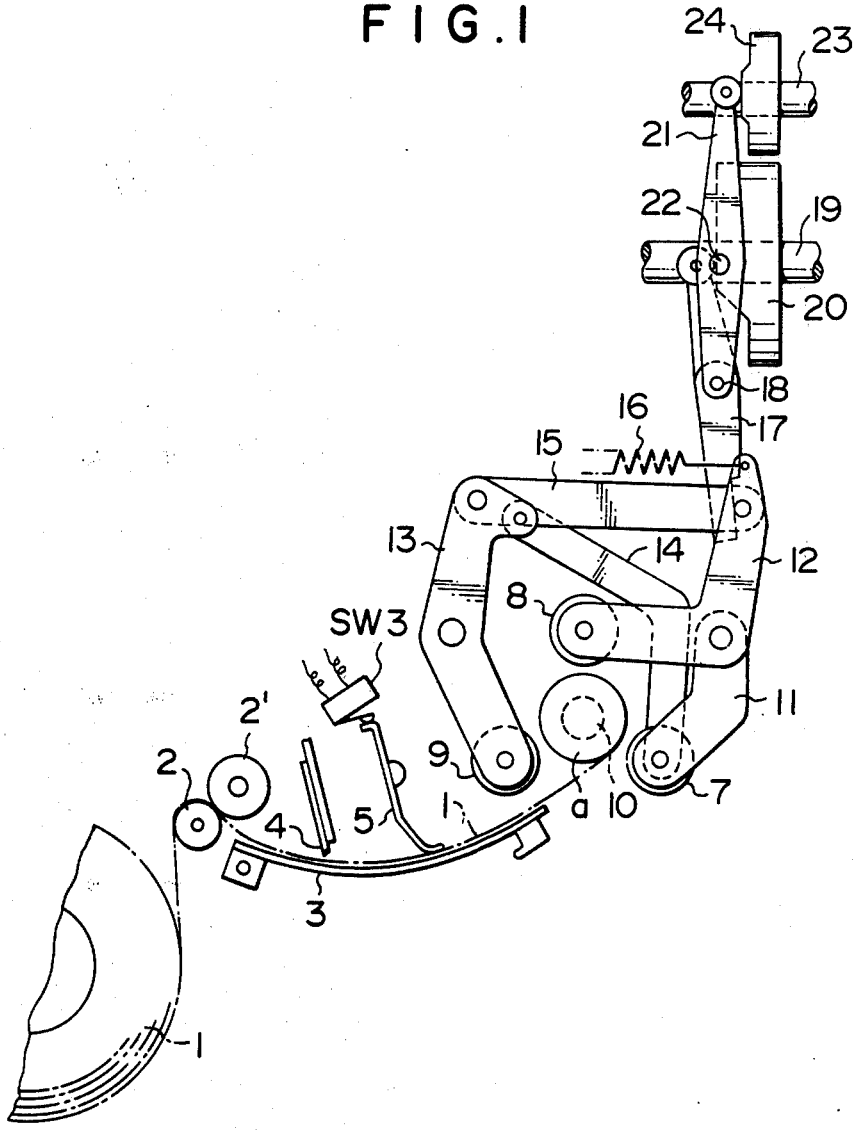
FIG. 1 is a plan view showing the packaging mechanism section of a coin packaging machine.

Referring to FIG. 1, a roll-like packaging paper 1 is fed out along a paper guide plate 3 by a set of feed rollers 2 and 2'. Reference numerals 4 and 5 represent a cutter for cutting the paper into a predetermined quantity according to the tension on the paper and a paper detecting plate for detecting the presence or absence of the packaging paper in the region of the paper guide plate 3, respectively. A paper detecting switch $SW_3$ is co-operatively connected to this detecting plate 5.

Accumulated coins a are shifted toward the center of packaging rollers 7, 8 and 9 from the interior of an accumulating cylinder by means of a supporting rod 10. The respective packaging rollers 7, 8 and 9 are rotated co-operatively with one another by means of link members 11, 12 and 13 and connecting levers 14 and 15. These rollers 7, 8 and 9 are urged by a spring 16 to converge toward the accumulated coins a through the link members 11, 12 and 13 and the connecting levers 14 and 15. Parts of the link members are engaged with one end of an opening-closing lever 17, and the other end of the lever 17 is caused to come into contact with a face cam 20 provided on a cam shaft 19 with a shaft 18 acting as the fulcrum. The shaft 18 is connected to one end of a setting lever 21 and is arranged so that its position is changed by a cam face of an opening position-setting cam 24 on a setting shaft 23, with which the other end of the setting lever 21 comes into contact, with a supporting shaft 22 acting as the center of the change of position.

When the forward end of the packaging paper 1 is fed out to the normal position along the paper guide plate 3 at a predetermined timing as shown in FIG. 1, the packaging paper is introduced between the accumulated coins and the packaging rollers by means of the packaging rollers and is abruptly pulled. The paper detecting switch $SW_3$ is therefore actuated through the paper detecting plate 5. At this point, the packaging motor rotates the cam shaft 19 through one revolution in the normal direction to complete the normal packaging operation. This operational relationship will now be described by reference to FIGS. 2 and 3.

As will be apparent from the above-illustrated structure, rotation of the face cam 20 attached to the cam shaft 19 is for supporting accumulated coins on the packaging rollers 7, 8 and 9 and separating the accumulated coins therefrom. Namely, at the point B, access to the packaging rollers 7, 8 and 9 is initiated, and at the point A, the accumulated coins are gripped and supported by these packaging rollers. In this state, another group of cams (not shown) mounted on the cam shaft 19 are operated to actuate clamp jaws and packaging is completed during travel to the point C. Simultaneously, the accumulated coins are released from the gripping action of the packaging rollers 7, 8 and 9. A shutter cam 26 is disposed to open and close a shutter mounted on the bottom of the accumulating cylinder so that the shutter is opened before arrival at the point B to shift the coins accumulated in the accumulating cylinder to the position surrounded by the packaging rollers 7, 8 and 9 by means of the supporting rod. During the period, a timing switch SW5 is maintained to be open substantially up to the point A.

Figure 3:
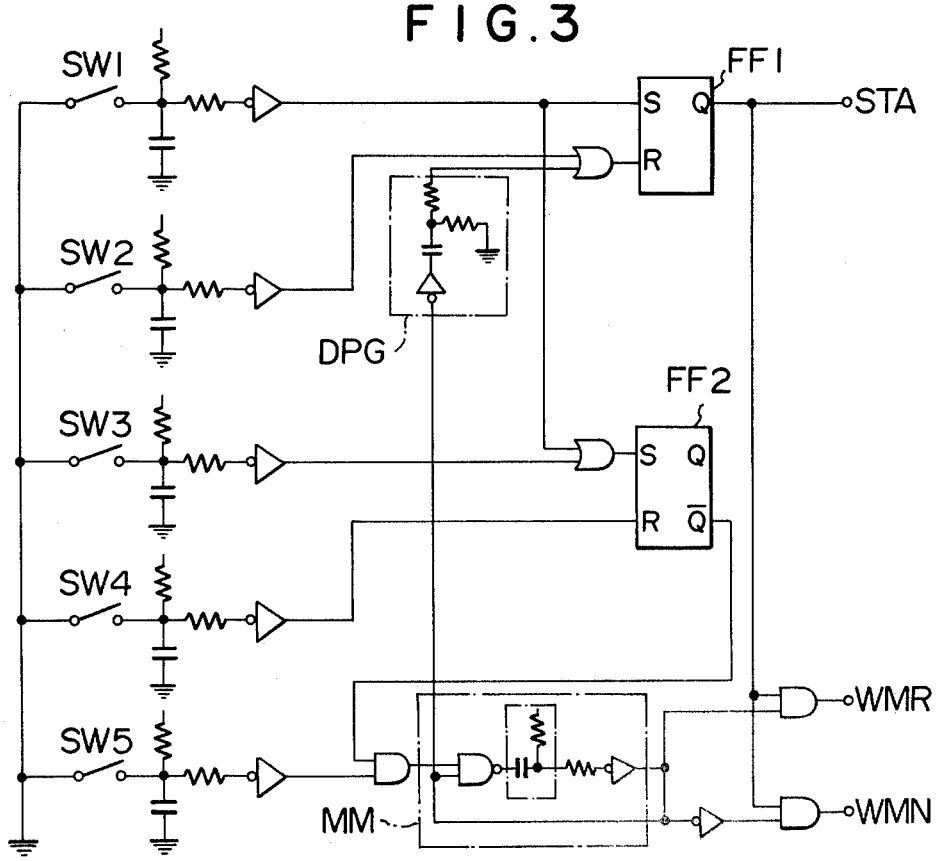
FIG. 3 is a circuit diagram.

In a circuit of FIG. 3, when a start switch $SW_1$ is depressed, a starting flip-flop FF1 is set and simultaneously a paper detecting flip-flop FF2 is set. Furthermore, the flip-flop FF2 is also set when the paper detecting switch $SW_3$ is actuated or closed. By setting the flip-flop FF1, the machine is started and simultaneously an ouput is given to a forward rotation output terminal WMN of the packaging motor to forwardly rotate the packaging motor. For this, as mentioned above, the cam shaft 19 starts to rotate.

When a shutter is opened by the shutter cam 26, a switch $SW_4$ is closed to reset the flip-flop FF2.

Figure 2:
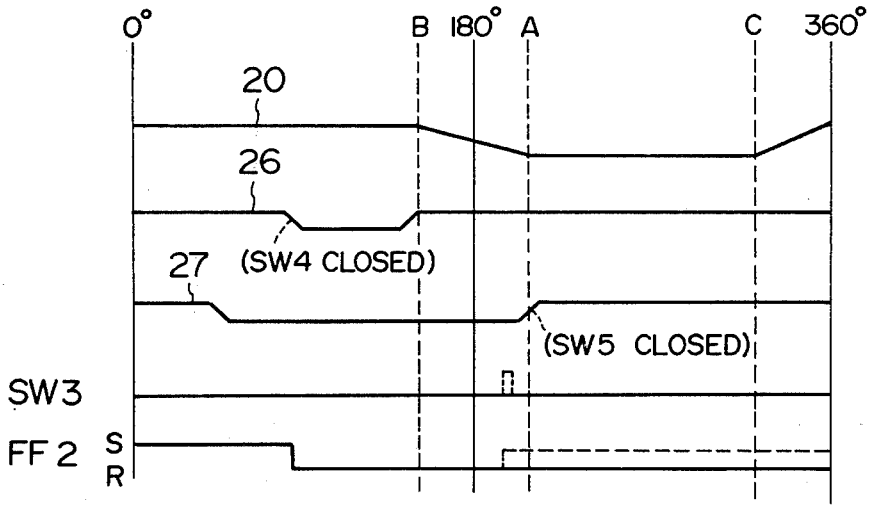
FIG. 2 is a diagram illustrating the operation timings of the cams and switches.

When the packaging paper 1 is located at the normal position and the packaging operation progresses, the paper detecting switch $SW_3$ is actuated by the tension of the packaging paper in a position shown in dotted lines of FIG. 2, the flip-flop FF2 is set again as shown in dotted lines of FIG. 2. In this way, since the setting of the flip-flop FF2 is made eariler than the closing of the switch $SW_5$ by the timing cam 27, there is no output at the output terminal $\overline{Q}$ of the flip-flop FF2 and, therefore a monostable multivibrator MM is not actuated. For this, the output is continuously given to the forward rotation output terminal WMN and, therefore, the packaging operation continues.

On the other hand, when the packaging paper 1 is not guided along the paper guide plate 3 but caught en route, since the paper detecting switch $SW_3$ is not actuated, the paper detecting flip-flop FF2 is not set and at the point A where the switch $SW_5$ is closed by the timing cam 27, the monostable multivibrator MM is triggered to put out a pulse. Consequently, an output is not given to the forward rotation output terminal WMN and instead an output is given to the reverse rotation output terminal WMR to cause the packaging motor to rotate. The width of the output pulse from the monostable multivibrator MM is selected so that the packaging motor is reversely rotated from point A to point B. The output pulse is reversed and differentiated by a delayed pulse generator DPG so that the trailing edge of the output pulse gives a delayed positive pulse delayed by the width of the output pulse to a reset input terminal R of the flip-flop FF1 to reset the flip-flop FF1. As a result, the packaging motor and the operation of the machine are stopped at the point B.

Furthermore, a switch $SW_2$ is provided for optionally stopping the operation of the machine and the packaging motor. In this way, the accumulated coins a are not gripped or supported by the packaging rollers 7, 8 and 9 but are stopped in the original state at the point of delivery to the packaging rollers by the supporting rod 10. The operation of the machine stops at the same time.

When the packaging paper 1 is set at the normal position again and the start switch $SW_1$ is closed, the operation from the point B is again initiated.

We claim:

1. A coin packaging machine comprising a plurality of packaging rollers capable of moving in converging and expanding directions, a supporting rod for introducing accumulated coins among said rollers, paper detecting means for detecting whether a packaging paper to be wound on the accumulated coins is fed to the packaging rollers at a predetermined timing, a flip-flop device connected to said detecting means and means for selectively rotating a packaging motor in a normal or reverse direction according to the level of an output signal from the flip-flop device, wherein when non-feeding of the packaging paper is detected by said detecting means, a signal for rotating the packaging motor in the reverse direction is issued from the flip-flop device in response to a detection signal from the detecting means to rotate the packaging motor in the reverse direction, whereby the packaging rollers are reversely fed until the nongripped state in which the accumulated coins are introduced among the packaging rollers and then the packaging rollers are stopped in the state.

2. A coin packaging machine wherein accumulated coins are packaged with a supplied packaging paper by a plurality of packaging rollers which are moved by a packaging motor between a first position in which the accumulated coins are introduced among the packaging rollers and not gripped thereby and a second position in which the accumulated coins are gripped and wound with the packaging paper by the packaging rollers, characterized in that a paper detecting means is provided for detecting the presence of the packaging paper fed to the packaging rollers and a circuit means connected to the paper detecting means is constructed to reversely rotate the packaging motor so as to move the packaging rollers from substantially said second position to said first position and make the stoppings of the packaging motor and the machine in response to nonpresence of the packaging paper sensed by the paper detecting means.

3. A coin packaging machine as set forth in claim 2, said circuit means comprises a first flip-flop starting the operation of the machine and the packaging motor by depressing a start button, a second flip-flop connected to a paper detecting switch so as to cause the second flip-flop to be set by the closing of the paper detecting switch, a monostable multivibrator connected to one output of the second flip-flop and the timing switch so as to generate a pulse by the closing of the timing switch when the second flip-flop has been not set by the paper detecting switch and, therefore, reversely rotate the packaging motor, and a delayed pulse generator connected between the output of the monostable multivibrator and the input of the first flip-flop for generating a delayed pulse from the trailing edge of the output of the monostable multivibrator and, therefore, setting the first flip-flop whereby the operation of the machine and the packaging motor are stopped when the packaging rollers are reversely moved up to said first position.

* * * * *